US005261299A

United States Patent [19]

Kondos

[11] Patent Number: 5,261,299

[45] Date of Patent: Nov. 16, 1993

[54] BOTTLE OPENER

[76] Inventor: Stephen Kondos, Box 265, New Wilmington, Pa. 16142

[21] Appl. No.: 973,774

[22] Filed: Nov. 9, 1992

[51] Int. Cl.[5] ..... B67B 7/44

[52] U.S. Cl. ..... 81/3.09; 81/3.55; 81/3.57; 2/20; 2/160

[58] Field of Search ..... 81/3.07, 3.09, 3.55, 81/3.57; 2/161 R, 161 A, 20

[56] References Cited

U.S. PATENT DOCUMENTS

| | | | |
|---|---|---|---|
| D. 205,370 | 7/1966 | Roeschlaub | 81/3.57 |
| 3,495,284 | 2/1970 | Weingardt | 81/3.55 |
| 3,500,477 | 3/1970 | Meszaros | 2/161 R |
| 4,805,238 | 2/1989 | Crafts | 2/161 R |
| 4,894,866 | 1/1990 | Walker | 2/161 R |
| 5,133,233 | 7/1992 | Erwin | 81/3.37 |

*Primary Examiner*—Roscoe V. Parker

*Attorney, Agent, or Firm*—Lovercheck and Lovercheck

[57] ABSTRACT

A bottle opening device with a bottle opener having a handle supported on a flexible sheet of material. The sheet of material has two straps and an intermediate part. The intermediate part has the handle of the bottle opener fixed to it and rests in the palm of the user's hand. The intermediate part extends from the palm and has two spaced openings to receive the middle finger and the ring finger of the user's hand. The intermediate part extends under the wrist of the hand and has two straps fixed to it. The straps are for example, like VELCRO-type material by which the straps can be attached together to hold the opener in place.

3 Claims, 2 Drawing Sheets

BOTTLE OPENER

BACKGROUND OF THE INVENTION

The present invention relates to bottle opening devices and more particularly, to a flexible support for a conventional bottle opener. The support holds the bottle opener in a natural position in the hand of the user so that the forces of the bottle opener will be exerted on a flexible member and not irritate the hand of the user. The opener will be at all times ready for use in a natural position regardless of other uses the operator may make with his hand. The flexible support accommodates the middle finger and ring finger of the operator. The support extends inside the operator's palm to the wrist and has straps that extend around the wrist of the operator and are held in place by a VELCRO-type material.

Applicant is aware of the following patents that show various types of bottle opener supports:

U.S. Pat. Nos. 3,500,477; 4,805,238; 4,894,866 and 5,133,233. None of these patents show a bottle opener that can be held in the palm of a hand in a natural position while the hand is free for use in other functions when the opener is not in use.

SUMMARY OF THE INVENTION

The typical prior art bottle opener has an opening in one end and a handle to be gripped by the operator. The opening may be oblong and one edge of the opening may have and edge to fit under the rim of the bottle cap that is to be removed from the bottle.

Prior art bottle openers are usually laid aside, when not in use and can be misplaced causing problems for a professional bartender who lays down his bottle opener while performing other duties. Even if not misplaced, picking up the opener requires time in a busy bar.

It is an object of the invention to provide an improved bottle opener and support.

Another object of the invention is to provide a bottle opener support by which the opener is held in a natural position in the user's hand will not interfere with other tasks and will be in use position while the hand is being used for other purposes without readjusting the bottle opener.

Another object of the invention is to provide a bottle opener that is simple in construction, economical to manufacture and simple and efficient to use.

With the above and other objects in view, the present invention consists of the combination and arrangement of parts hereinafter more fully described, illustrated in the accompanying drawing and more particularly pointed out in the appended claims, it being understood that changes may be made in the form, size, proportions and minor details of construction without departing from the spirit or sacrificing any of the advantages of the invention.

BRIEF DESCRIPTION OF THE DRAWING(S)

DESCRIPTION OF THE PREFERRED EMBODIMENT(S)

Figure 1:
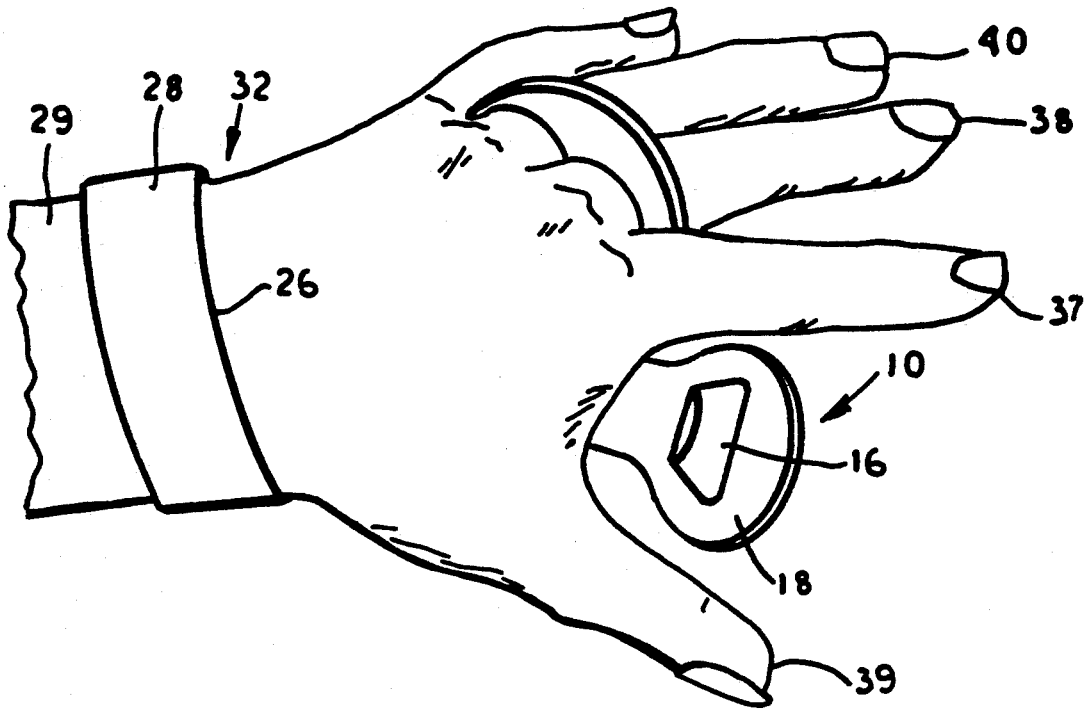
FIG. 1 is a perspective view of the front of the hand with the bottle opener thereon according to the invention.

Now with more particular reference to the drawings, FIG. 1 shows combination 10 of bottle opener 12 and support 14. Bottle opener 12 is of a general type that is popular for use in taverns, bars, homes and the like. Bottle opener 12 has a relatively flat rigid body which may be made of stainless steel or other suitable materials and has cap receiving opening 16 in first end 18, hook 17 integrally attached to the margin of opening 16 to underlie an edge of a bottle cap, and handle 20 on second end 22.

Support 14 is made up of relatively flat, generally Y-shaped piece of flexible material having intermediate part 24, first strap 26 integrally connected to intermediate part 24 and second strap 28 integrally connected to intermediate part 24.

Figure 2:
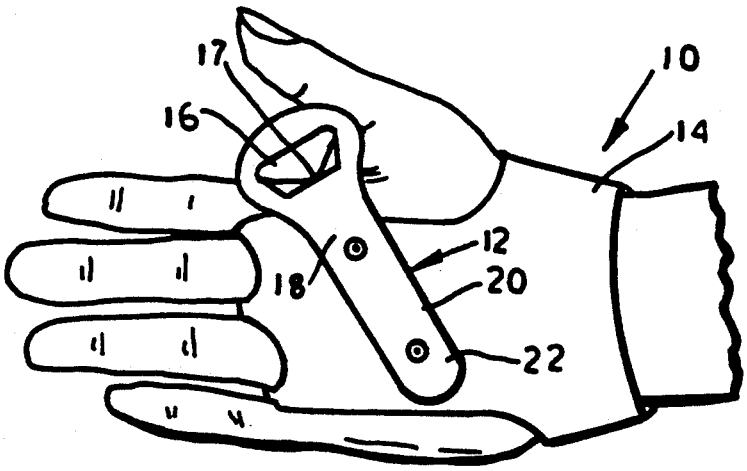
FIG. 2 is a rear view of the hand with the bottle opener on the support.
Figure 3:
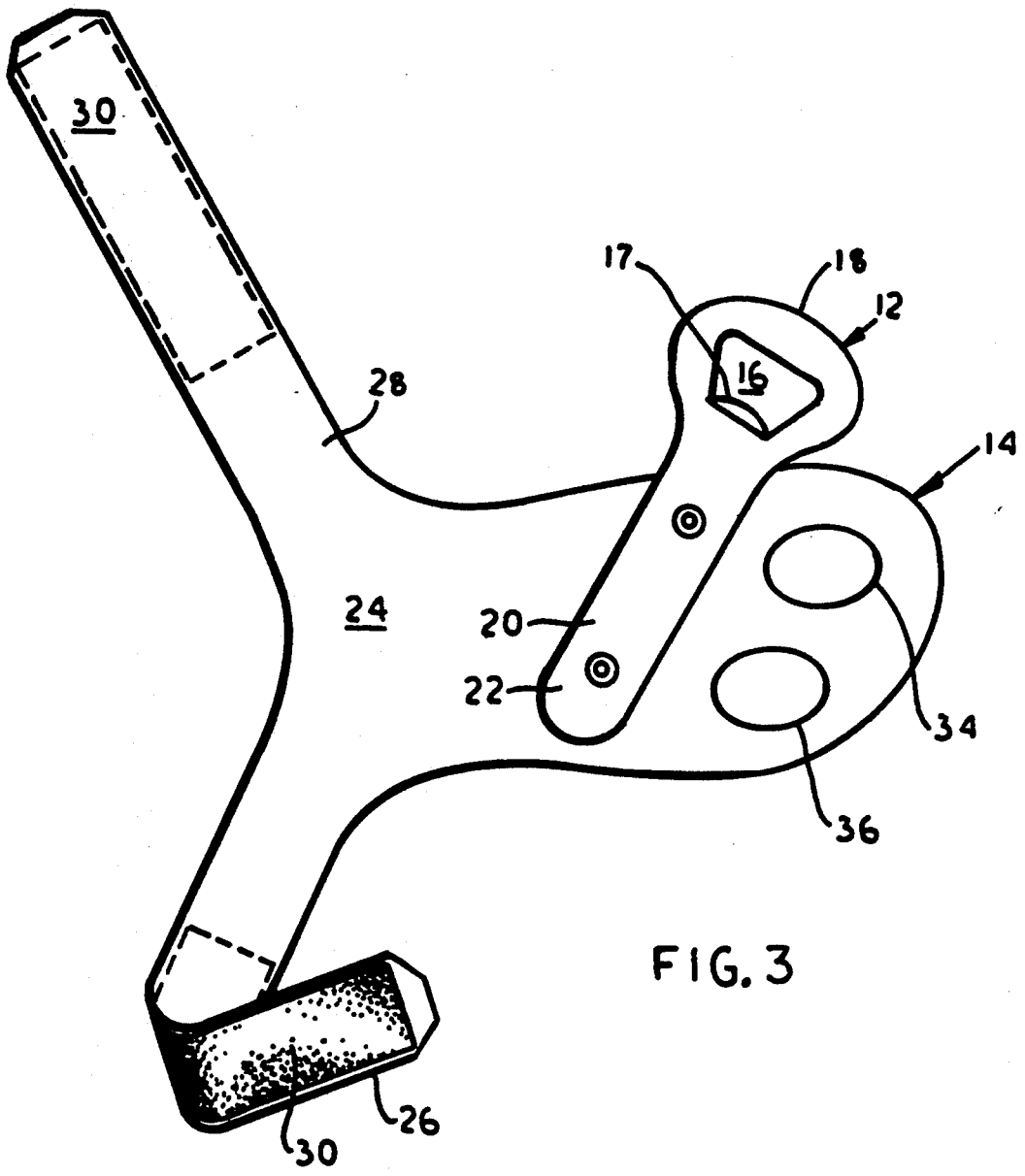
FIG. 3 is a top view of the bottle opener support and bottle opener spread out flat.

First strap 26 and second strap 28 are disposed at an obtuse angle to one another, as shown FIGS. 1 and 2. First strap 26 and second strap 28 extend from intermediate part 24 around wrist 29 of the user. First strap 26 and second strap 28 may have strip 30 of a VELCRO-type material thereon so that when first strap 26 and second strap 28 are placed around wrist 29 of the user, they will form a bracelet-type closure and hold intermediate part 24 of support 14 on hand 32.

Hand 32 is free for other functions when bottle opener 12 is not in use. When it is desired to use bottle opener 12, it is in position for use without any adjustment whatsoever. The user merely has to close his fingers and thumb around handle 20 of bottle opener 12 and it is ready for use. To remove bottle opener 12 from hand 32, the user merely has to separate first strap 26 from second strap 28 and remove support 14. First finger receiving hole 34 and second finger receiving hole 36 in intermediate part 24 receive middle finger 38 and ring finger 40 of hand 32. First finger receiving hole 34 and second finger receiving hole 36 are aligned generally with handle 20 of bottle opener 12.

The foregoing specification sets forth the invention in its preferred, practical forms but the structure shown is capable of modification within a range of equivalents without departing from the invention which is to be understood is broadly novel as is commensurate with the appended claims.

I claim:

1. In combination a bottle opener and a support;

said bottle opener being relatively flat and rigid and having a cap receiving opening, a first end, an elongated handle and a second end;

said support being a relatively flat, generally Y-shaped flexible sheet having an intermediate part, a first strap integrally attached to said intermediate part and a second strap integrally attached to said intermediate part;

said first strap being disposed at an obtuse angle to said second strap;

said intermediate part having a first finger receiving hole thereon to receive a middle finger of a hand;

said first strap and said second strap adapted to be wrapped around a wrist of a user and having attaching means thereon whereby said support is held in position for said bottle opener to open a bottle;

said handle extending between an index finger and thumb of said hand and generally parallel to said thumb when said combination is supported on a handle of a user and said thumb and finger are extended;

said support being supported on said hand with said ring finger received in a second finger receiving hole of said support;

said cap receiving opening in said bottle opener being adapted to receive a bottle cap; and, said intermediate part having said second finger receiving hole adapted to receive said ring finger of said hand.

2. The combination recited in claim 1 wherein said handle extends between an index finger and thumb of said hand whereby said support may be attached to said hand with said ring finger received in a second finger receiving hole of said support; and, said cap receiving opening in said bottle opener being adapted to receive a bottle cap.

3. The combination recited in claim 1 wherein said intermediate part has said second finger receiving hole adapted to receive said ring finger of said hand.

* * * * *